US007172794B2

(12) United States Patent
Chomer et al.

(10) Patent No.: US 7,172,794 B2
(45) Date of Patent: Feb. 6, 2007

(54) METHOD FOR TREATING FERROUS ALLOY PARTS IN ORDER TO IMPROVE THE RUBBING PROPERTIES THEREOF WITHOUT CAUSING HARDNESS LOSS OR DEFORMATION

(75) Inventors: Stéphane Chomer, Aveize (FR); Jean-Paul Terrat, Saint-Etienne (FR)

(73) Assignee: Centre Stephanois de Recherches Mecaniques Hydromecaniques et Frottement, Andrezieux-Boutheon (FR)

( * ) Notice: Subject to any disclaimer, the term of this patent is extended or adjusted under 35 U.S.C. 154(b) by 107 days.

(21) Appl. No.: 10/474,187

(22) PCT Filed: Mar. 28, 2002

(86) PCT No.: PCT/FR02/01091

§ 371 (c)(1),
(2), (4) Date: Mar. 15, 2004

(87) PCT Pub. No.: WO02/081769

PCT Pub. Date: Oct. 17, 2002

(65) Prior Publication Data

US 2004/0146753 A1 Jul. 29, 2004

(30) Foreign Application Priority Data

Apr. 4, 2001 (FR) ..... 01 04580

(51) Int. Cl.
*B05D 1/18* (2006.01)

(52) U.S. Cl. ..... 427/431; 427/435; 427/436; 428/336; 428/704; 428/682

(58) Field of Classification Search ..... 427/431, 427/435, 436; 428/704, 336, 682
See application file for complete search history.

(56) References Cited

U.S. PATENT DOCUMENTS 5,981,934 A * 11/1999 Higashikawa ..... 250/214 R
6,689,424 B1 * 2/2004 Wang et al. ..... 427/456

OTHER PUBLICATIONS

Antonucci P L et al:, "Fractal surface characterization of chalcogenide electrodeposits", Materials Science and Engineering B, Elsevier Sequoia, Lausanne, CH, vol. 38, No. 1, Mar. 1, 1996, pp. 9-15.

Vazquez L et al:, "Scanning tunneling microscopy characterization of the morphology of Fe/C multilayers grown on silicon substrates", Journal of Applied Physics, Jan. 1, 1994, USA, vol. 75, No. 1, pp. 248-254.

* cited by examiner

*Primary Examiner*—Alain L. Bashore
(74) *Attorney, Agent, or Firm*—Young & Thompson

(57) ABSTRACT

A method for obtaining a ferrous alloy part that supports a very high seizure load with very low dispersion includes steps of covering the part with an iron sulphide coating having an appropriate thickness and Fe/S ratio, where the coating is selected from among those with surfaces having a fractal dimension that is at least equal to 2.6.

5 Claims, No Drawings

METHOD FOR TREATING FERROUS ALLOY PARTS IN ORDER TO IMPROVE THE RUBBING PROPERTIES THEREOF WITHOUT CAUSING HARDNESS LOSS OR DEFORMATION

BACKGROUND OF THE INVENTION

The present invention relates to a method of treatment of ferrous alloy components to improve their friction properties, primarily their resistance to seizing and sticking, without risk of loss of hardness or of deformation.

The invention applies to components in steel or in cast iron with high mechanical properties, i.e. whose tempering temperature is below 200° C.

A person skilled in the art knows that two steel components rubbing against one another, in the absence of lubricant, will seize very quickly. A person skilled in the art also knows that the role of lubricants consists of separating the contacting surfaces by means of a film that promotes sliding and the release of heat. The lubricant film makes it possible to prevent the development of microwelds, which are responsible for seizing and transfer of material.

To be effective, the lubricant film must have a thickness that is greater than the height of the surface asperities. The film thickness largely depends on the physicochemical surface properties and on the surface morphology at the microscopic scale. However, steel straight from machining has surface characteristics such that the thickness of the films of lubricant is as a rule insufficient to ensure continuous lubrication when the loads or speeds become large.

Surface treatments for steels have been developed with the aim of improving either the absorption of the lubricant or the anti-welding characteristics or even both simultaneously.

Two categories of treatment are currently used in the mechanical engineering industry for improving lubricant retention: phosphatation and low-temperature sulphuration. Phosphatation is mainly intended to increase the resistance to seizing of lubricated contacts, and sulphuration additionally endows the surface with properties of inhibition of welding owing to the formation of iron sulphide (hexagonal FeS), and the antiseizing properties are then superior to those obtained with phosphatation.

The physicochemical properties of compounds such as iron phosphate or iron sulphide account for the improved wetting of the lubricants, as the surface energy of these constituents is far higher than that of steel. Furthermore, these constituents have low resistance to shear, as well as excellent capacity for accommodation, which enables them to improve the conditions of running-in and the resistance to wear of contacts that are subjected to surface fatigue.

Electrolytic sulphuration in fused salts in brine is described in FR-A-1 406 530.

Low-temperature sulphuration is effected in a mixture of molten salts at a temperature of about 200° C. using anodic electrolysis, leading to the formation of hexagonal iron sulphide FeS. This last-mentioned method is described in the Applicant's patent FR-A-2 050 754.

Nevertheless, components coated in accordance with the prior art no longer meet the new requirements, especially with respect to the mechanisms employed in the new generations of direct-injection engines.

SUMMARY OF THE INVENTION

One object of the invention is to obtain ferrous alloy components possessing improved friction properties in extreme conditions of pressure and speed, mainly their resistance to seizing and sticking without loss of hardness or deformation.

This aim, as well as others that will become clear on reading the description given below, is satisfied by the method of the present invention.

DETAILED DESCRIPTION OF THE PREFERRED EMBODIMENTS

The Applicant found, surprisingly, that for ferrous alloy components with a coating of iron sulphide, the fractal dimension of the surface of the iron sulphide coating played a decisive role, and at any event had a much greater influence than stoichiometry, crystalline structure, or purity.

The Applicant therefore developed a method of obtaining a ferrous alloy component that supports a very high seizing load with a very low dispersion as well as a high number of cycles, consisting of depositing, on the said component, an iron sulphide coating having an appropriate thickness and Fe/S ratio, characterized in that the coating is selected from those whose surface has a fractal dimension at least equal to 2.6.

For example, the components obtained according to the method of the present invention withstand a seizing load in the test on the FAVILLE LEVALLY machine according to standard ASTM-D-2670 equal to at least about 3000 daN with a maximum tolerance equal to about 5% and a number of cycles according to the Hamsler test equal to at least about 300.

A person skilled in the art will easily determine the appropriate thickness and Fe/S ratio. As shown in the examples given below, a thickness that is too small is insufficient to guarantee resistance to seizing despite a fractal dimension equal to at least 2.6, and a thickness that is too large makes it impossible to obtain a fractal dimension equal to at least 2.6. These parameters will have to be adjusted experimentally, for each individual case.

Advantageously, the coating is selected from those whose surface has a fractal dimension between 2.65 and 2.75.

In a preferred embodiment of the invention, the coating is selected from those having a stoichiometry corresponding to an Fe/S ratio between about 0.69 and 0.85.

It will also be favourable to select the coating from those having a thickness less than about 15 μm, and even better, below about 6 μm.

The fractal dimension is obtained with the aid of a roughness indicator, for example a 3D roughness indicator of contactless, confocal type having the following characteristics:

| | |
|---|---|
| Lateral resolution | 300 nm |
| Vertical resolution | 30 nm |
| Vertical displacement | 1 mm |

The data obtained using the roughness indicator is then entered in a special calculation algorithm which extracts the mathematical quantities required for obtaining the fractal dimension.

It should be noted that the use of a high-resolution roughness indicator is essential for ensuring accurate measurement of the fractal dimension. It is also important to use a contactless roughness indicator in order to guarantee that the surface morphology is not changed in any way during measurement of the roughness profiles.

Iron sulphide coatings are produced on ferrous alloy components by treatments that are known to a person skilled in the art, for example by electrolytic sulphuration in a fused salt bath according to patent FR-A-1 406 530, or sulphuration in brine, or sulphuration in a salt bath as has been demonstrated experimentally by the Applicant.

The present invention also relates to the components selected according to the method described.

The following examples provide a non-limiting illustration of the invention.

EXAMPLE 1

Cylindrical specimens (cylinders) with diameter of 6.35 mm and height of 40 mm, in steel 16 NC6 that had undergone cementation, quenching and surface treatment, were treated in the following conditions:

| Condition 1: Electrolytic sulphuration in fused salts according to patent FR-A-1 406 530 | |
|---|---|
| Treatment temperature: | 190° C. |
| Immersion time: | 15 minutes |
| Composition of brine (wt. %): | $SCN^-$ = 62.75% |
| | $Na^+$ = 7.1% |
| | $K^+$ = 30.15% |
| Current density: | 2.8 to 3.2 A/dm$^2$ |

| Condition 2: Sulphuration in brine | |
|---|---|
| Treatment temperature: | 100 to 135° C. |
| Immersion time: | 3 to 10 hours |
| Composition of brine (wt. %): | $OH^-$ = 8.50% |
| | $S_2O_8^{2-}$ = 12.10% |
| | $S_2O_3^{2-}$ = 8.86% |
| | $Cl^-$ = 1.52% |
| | $Na^+$ = 19.02% |

-continued

| Condition 3: Sulphuration in salt bath | |
|---|---|
| Treatment temperature: | 180 to 280° C. |
| Immersion time: | 1.5 to 3 hours |
| Composition of brine (wt. %): | $OH^-$ = 2.10% |
| | $S_2O_8^{2-}$ = 24.20% |
| | $S_2O_3^{2-}$ = 17.75% |
| | $HSO_4^-$ = 33.75% |
| | $NH_4^-$ = 6.25% |
| | $Na^+$ = 15.95% |

After treatment, the specimens have a coating of iron sulphide. The specimens are then oiled and tested on the FAVILLE LEVALLY machine (according to ASTM-D-2670), causing the treated cylinder to rotate between two jaws of steel 16NC6 that had undergone cementation and quenching but no additional treatment. The test consists of increasing the load applied to the cylinder until seizing occurs. Then the seizing load is determined, the tests having been reproduced 5 times in order to evaluate the mean seizing load as well as the measurement dispersion.

Each cylinder is characterized prior to testing in order to determine the fractal dimension of the coating surface after treatment. The fractal dimension is obtained using a 3D roughness indicator of contactless, confocal type that has the following characteristics:

| | |
|---|---|
| Lateral resolution | 300 nm |
| Vertical resolution | 30 nm |
| Vertical displacement | 1 mm |

The data obtained with the roughness indicator is then entered in a special calculation algorithm that extracts the mathematical quantities required for obtaining the fractal dimension.

According to the invention, coatings whose surface has a fractal dimension equal to at least 2.6 are selected.

The results obtained are presented in the following Table I and compared, in the same test conditions. For comparison, untreated specimens seize right at the start of the test.

TABLE I

| Treatment of the cylinder | Fractal dimension of the coating surface (D) | Fe/S ratio (±0.2) | Layer thickness (±1 μm) | Mean seizing load (daN) | Dispersion (%) |
|---|---|---|---|---|---|
| Condition 1, 15 min at 2.8 A/dm$^2$ | 2.18 | 0.80 | 5 | 1600 | 20 |
| Condition 1, 15 min at 3.2 A/dm$^2$ | 2.23 | 0.81 | 5 | 1500 | 20 |
| Condition 2, 10 h at 100° C. | 2.30 | 0.80 | 5 | 1600 | 20 |
| Condition 2, 7 h at 110° C. | 2.45 | 0.79 | 5 | 1700 | 20 |
| Condition 2, 5 h at 120° C. | 2.55 | 0.81 | 5 | 1700 | 20 |
| Condition 2, 3 h at 130° C. | 2.60 According to the invention | 0.80 | 5 | 4800 | 5 |
| Condition 2, 3 h at 135° C. | 2.65 According to the invention | 0.78 | 5 | 5200 | 5 |

TABLE I-continued

| Treatment of the cylinder | Fractal dimension of the coating surface (D) | Fe/S ratio (±0.2) | Layer thickness (±1 μm) | Mean seizing load (daN) | Dispersion (%) |
|---|---|---|---|---|---|
| Condition 3, 2 h at 200° C. | 2.71 According to the invention | 0.81 | 5 | 5000 | 5 |
| Condition 3, 1 h 45 min at 250° C. | 2.79 According to the invention | 0.81 | 5 | 5200 | 5 |
| Condition 3, 1 h 30 min at 280° C. | 2.83 According to the invention | 0.79 | 5 | 5100 | 5 |

The components (cylinders) according to the invention exhibit a seizing load in the test on the FAVILLE LEVALLY machine according to standard ASTM-D-2670 equal to at least about 3000 daN.

It is also observed that the cylinders coated with iron sulphide according to the invention have a seizing load that is about 3 times higher than the best results obtained up to now with iron sulphide with a small fractal dimension.

In addition, the dispersion of the results is 4 times less when the iron sulphide has a fractal dimension greater than 2.6.

EXAMPLE 2

Tests were conducted according to standard DIN 51350 (parts 1 to 5) on a so-called "four-ball tester" to supplement the seizing tests and verify the influence of the Fe/S ratio and of the thickness of the layer of iron sulphide.

Disks of steel 15CrMo4 that had undergone cementation and quenching to give HRC 60, with diameter of 60 mm and thickness of 10 mm, were treated in conditions 1, 2 and 3 described in Example 1 and in an additional condition described hereunder:

| Condition 4: Sulphuration in brine | |
|---|---|
| Treatment temperature: | 100 to 130° C. |
| Immersion time: | 3 h 10 min |
| Composition of brine (wt. %): | $OH^-$ = 10.52% |
| | $S_2O_8^{2-}$ = 9.8% |
| | $S_2O_3^{2-}$ = 5.74% |
| | $Cl^-$ = 0.55% |
| | $Na^+$ = 19.12% |

After treatment, the components have an iron sulphide coating.

The tests are conducted in a bath of pure mineral oil at 60° C. The mean seizing loads and the dispersions obtained from 5 tests are presented in the following table. The fractal dimension of the coating surface was measured using the same device as that described in Example 1. The results are given in Table II.

TABLE II

| Treatment | Fractal dimension of the coating surface (D) | Fe/S ratio (±0.2) | Layer thickness (±1 μm) | Mean seizing load (daN) | Dispersion (%) |
|---|---|---|---|---|---|
| Condition 1, 15 min at 2.8 A/dm$^2$ | 2.23 | 0.81 | 5 | 300 | 20 |
| Condition 1, 15 min at 3.2 A/dm$^2$ | 2.65 According to the invention | 0.69 | 5 | 1700 | 5 |
| Condition 2, 10 h at 100° C. | 2.65 According to the invention | 0.78 | 5 | 1700 | 5 |
| Condition 2, 7 h at 110° C. | 2.65 According to the invention | 0.85 | 5 | 1700 | 5 |
| Condition 2, 5 h at 120° C. | 2.65 | 0.78 | 0.5 | 40 | 20 |
| Condition 2, 3 h at 130° C. | 2.65 According to the invention | 0.78 | 1.5 | 1700 | 5 |
| Condition 2, 3 h at 135° C. | 2.65 According to the invention | 0.78 | 10 | 1700 | 5 |
| Condition 2, 3 h at 130° C. | 2.65 According to the invention | 0.80 | 15 | 1700 | 5 |
| Condition 2, 3 h at 135° C. | 2.55 | 0.78 | 20 | 320 | 15 |

According to the invention, coatings are selected from those whose surface has a fractal dimension equal to at least 2.6.

coating surface of each cylinder was measured using the device described in Example 1.

The results obtained are presented in Table III.

TABLE III

| Treatment | Fractal dimension of the coating surface (D) | Fe/S ratio (±0.2) | Layer thickness (±1 μm) | Number of cycles carried out | Dispersion (%) |
|---|---|---|---|---|---|
| Condition 1, 15 min at 2.8 A/dm$^2$ | 2.18 | 0.80 | 5 | 300 | 20 |
| Condition 1, 15 min at 3.2 A/dm$^2$ | 2.23 | 0.81 | 5 | 1700 | 20 |
| Condition 2, 10 h at 100° C. | 2.30 | 0.80 | 5 | 1700 | 20 |
| Condition 2, 7 h at 110° C. | 2.45 | 0.79 | 5 | 1700 | 20 |
| Condition 2, 5 h at 120° C. | 2.55 | 0.81 | 5 | 40 | 20 |
| Condition 2, 3 h at 130° C. | 2.60 According to the invention | 0.80 | 5 | 1700 | 5 |
| Condition 2, 3 h at 135° C. | 2.65 According to the invention | 0.78 | 5 | 1700 | 5 |
| Condition 2, 3 h at 130° C. | 2.71 According to the invention | 0.81 | 5 | 1700 | 5 |
| Condition 2, 3 h at 135° C. | 2.79 According to the invention | 0.81 | 5 | 320 | 5 |
| Condition 2, 3 h at 135° C. | 2.83 According to the invention | 0.79 | 5 | 320 | 5 |

It can also be seen that if components are additionally selected that have a coating whose Fe/S ratio is in the range 0.69 to 0.85, the seizing load and the dispersion are not affected. The same applies to coating thicknesses between 1.5 and 15 μm. On the other hand, a thickness of 0.5 μm is insufficient to guarantee resistance to seizing, and for a thickness of 20 μm it is not possible to obtain iron sulphide with a fractal dimension equal to at least 2.6.

EXAMPLE 3

For characterizing the relevance of selecting components having a fractal iron sulphide coating for enduring difficult conditions of contacts with unstable lubrication, a simulation was carried out, sliding two cylinders of identical diameter against one another at a speed of 5 m.s$^{-1}$ and pressure of 1200 MPa. The contact is supplied with oil 600 NS at 80° C. (16 cSt) during the running-in phase of 1 hour and then lubrication is stopped. Lubrication is resumed as soon as the coefficient of friction reaches the critical value of 0.085 (friction in conditions of boundary lubrication) then is stopped again when the latter reaches a stabilized value around 0.04. The operation is then repeated and the number of cycles before irreversible seizing is recorded.

The cylinders were treated and selected in conditions 1, 2 and 3 described previously. The fractal dimension of the According to the invention, the coatings are selected from those whose surface has a fractal dimension equal to at least 2.6.

The invention claimed is:

1. Method of obtaining a ferrous alloy component having an increased resistance to sticking and seizing, without risk of loss of hardness or of deformation, comprises the step of depositing, on the ferrous alloy component, an iron sulphide coating having a first thickness and having a stoichiometry corresponding to an Fe/S ratio between about 0.69 and 0.85, said coating having a fractal dimension at least equal to 2.6.

2. Method according to claim 1, characterized in that the coating is selected from those whose surface has a fractal dimension between 2.65 and 2.75.

3. Method according to claim 1, characterized in that the coating is selected from those having a thickness less than about 15 μm.

4. Method according to claim 3, characterized in that the coating is selected from those having a thickness below about 6 μm.

5. A ferrous alloy component obtained by depositing an iron sulphide coating on a ferrous alloy substrate, said coating having a first thickness and having a stoichiometry corresponding to an Fe/S ratio between about 0.69 and 0.85, said coating having a fractal dimension at least equal to 2.6.

* * * * *